United States Patent [19]

Klein

[11] 3,988,792

[45] Nov. 2, 1976

[54] INFLATABLE STRUCTURE FOR PRODUCING LOW RELIEF FIGURES

[76] Inventor: Charles Klein, Sierra Madre No. 110, Mexico City, Mexico

[22] Filed: July 7, 1975

[21] Appl. No.: 593,588

[52] U.S. Cl. ..... 5/365; 46/116; 46/135 R; 46/88

[51] Int. Cl.[2] ..... A47C 27/08

[58] Field of Search ..... 5/348 R, 349, 350; 40/126 R, 160, 136, 106.32, 106.43; 46/87, 88, 116, 135 R

[56] References Cited

UNITED STATES PATENTS

| | | | |
|---|---|---|---|
| 1,196,649 | 8/1916 | Backstahler | 46/135 R X |
| 2,960,794 | 11/1960 | Johns | 46/135 R |
| 3,141,261 | 7/1964 | Mirando | 46/135 R X |

*Primary Examiner*—Paul R. Gilliam
*Assistant Examiner*—Andrew M. Calvert
*Attorney, Agent, or Firm*—Ladas, Parry, Von Gehr, Goldsmith & Deschamps

[57] ABSTRACT

An inflatable structure which includes a resilient wall with cuts, of the type comprising a print of allusive drawing on one of its surfaces, wherein said structure is composed substantially of an inflatable cushion having in the outer surface of one of its sides a resilient panel of considerable thickness attached thereto, and on the opposite side said cushion having a valve with cover for the admission of air or gas to inflate said structure, and in that the resilient panel of considerable thickness projects peripherally some distance beyond the edge of the cushion forming a flange and that it includes on the same wall attached to the cushion, near the edge thereof a slot, and includes a rigid support plate with ribs near the edges thereof which engages the slot of the flange of said resilient panel, and may include an adhesive for better attachment to the rigid support; said rigid support including also a perforation which coincides with the air or gas admission valve to permit the inflation of the structure, and the resilient panel having printed or drawn representations in which some of the lines are slits comprising printed on their inner surfaces suitable markings, whereby when the structure is inflated the resilient panel becomes significantly convex and furthermore the cuts open showing markings which could not be perceived when the structure was deflated, thus producing in a manner a low relief with three-dimensional visual impact.

3 Claims, 6 Drawing Figures

INFLATABLE STRUCTURE FOR PRODUCING LOW RELIEF FIGURES

BACKGROUND OF THE INVENTION

This invention relates in general terms to inflatable structures, such as cushions and the like, and particularly concerns improvements in an inflatable structure for producing ornamental figures in low relief.

Up to the present time inflatable structures which are initially smooth surfaces before inflation have produced, when inflated, similarly smooth surfaces on which, if it is desired to have some ornamental figure, the latter must be printed or drawn, giving the observer the impression of a flat surface. If it is desired to have some three-dimensional allusive figure which is obtained when an inflatable structure is inflated, it must be separately provided beforehand.

At the present time there is no inflatable structure which, consisting initially of a smooth surface with slits, produces when inflated a figure or representation in low relief, thereby producing on the observer the impact of greater realism than a mere flat figure can.

SUMMARY OF THE INVENTION

In consideration of the foregoing, it is one object of the present invention to supply an inflatable structure composed of a smooth surface having slits or incisions which upon inflation produce an ornamental figure in low relief. Depending on the type of cut made in one of the surfaces of the said inflatable structure, various images and effects may be obtained, and this permits of developing the creativity of the person acquiring the article: actually it is possible to offer an inflatable structure like a blank page on which the user can make cuts to obtain various creative effects.

In its principal embodiment the invention consists of an inflatable structure which includes at least one resilient wall or panel of a certain thickness which permits of making therein cuts of a certain depth no greater than the thickness of this resilient wall, whereby when the structure is inflated the incisions or cuts open and produce three-dimensional low relief which permits the production of more realistic allusive figures; thus if the latter include animal or humanoid figures the said cuts or slits can be employed to represent natural cavities, such as the mouth, the eyes, etc.

The inflatable structure may of course be a simple inflatable cushion, one of its walls being resilient and of such thickness as to permit the incisions. This structure may be mounted with the face opposite to the resilient panel being secured to a rigid platform permitting a valve to penetrate through a perforation for inflating the structure and having projecting portions on its periphery for suitable adherence thereupon of a flange of the inflatable structure, thus comprising substantially a frame which can be hung on a wall and which permits its owner to observe the figure in two diverse positions. Thus for example, if the said slits or incisions simulate the eyes and mouth of a humanoid, when the structure is deflated they are closed, but if the structure is inflated and the panel of the inflatable structure is stretched, it will seem to the observer that the figure opens its eyes and mouth; and thereby a certain dynamic property can be incorporated into the figure on the resilient structure as a characteristic of this invention: that is, the possibility of changing positions depending upon whether the structure is inflated or deflated.

These and other objects to achieved through the application of this invention will be better understood and more fully appreciated in reading the following description which refers to accompanying drawings of the preferred embodiment of the invention.

DETAILED DESCRIPTION OF THE INVENTION

Figure 4:
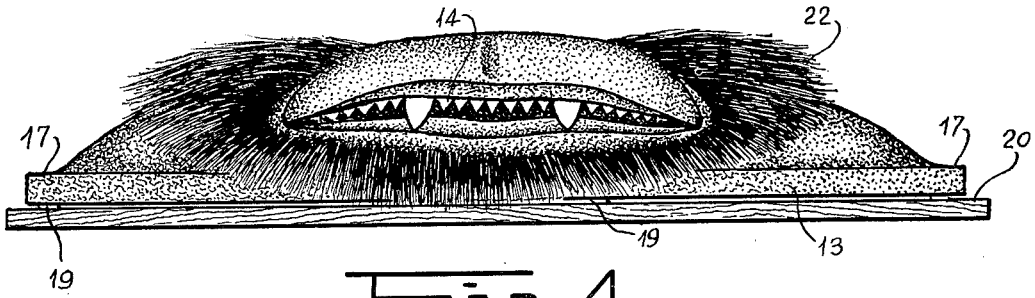
FIG. 4, is a lateral view of the structure shown in FIG. 3.

Now referring to the drawings, the inflatable structure, which includes at least one resilient wall with slits which take the shape of articles in low relief upon inflating, is composed of an inflatable bag or cushion comprising two lateral walls 11 and 12, joined to the outer surface of one of which, as for example 12, is an elastomeric resilient panel 13 of considerable thickness which permits slits or incisions 14 therein, said inflatable bag having on its other wall 11 a valve 15 with its cover 16, which permits of inflating the said structure. The elastomeric resilient panel 13 extends with its edges some distance beyond the edge of the inflatable bag forming a flange 17 which includes on the side with which it adheres to the inflatable bag a slot 18 all around the periphery thereof, which engages with projections 19 of rigid support structure 20, including this latter a central perforation 21 coinciding with valve 15 to permit the inflation of the structure. The other wall 11 of the inflatable bag which is not attached to said elastomeric resilient panel 13 can be mounted with an adhesive on its outer surface to said rigid support 20, whereby upon inflating the elastomeric panel is caused to bulge out, as is illustrated in FIG. 4. As can be appreciated in FIG. 1, to give an example of dynamic figured representation, a gorilla is illustrated upon which there have been made slits or incisions corresponding to the eyes and the mouth, whereby when the inflatable structure is inflated, the gorilla opens its eyes and mouth showing all the teeth, and this, combined with the convex shape of the image offered by the elastomeric resilient panel 13, produces a low relief of striking effect.

Figure 5:
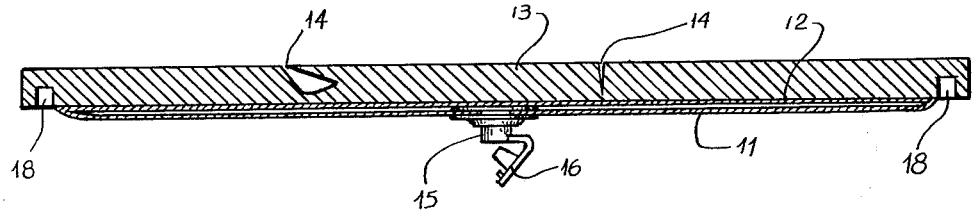
FIG. 5, is a view in longitudinal section of an inflatable structure without the rigid support thereof, showing the slits or incisions in their deflated position.
Figure 6:
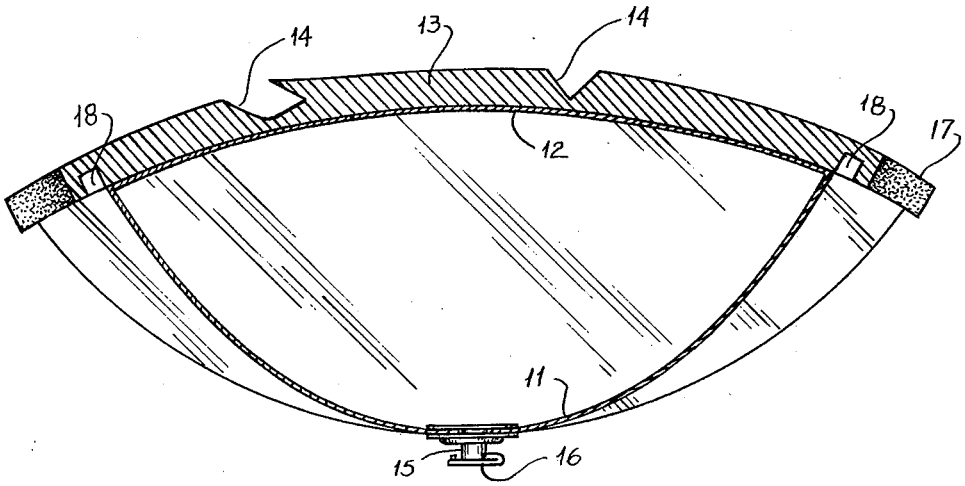
FIG. 6, is a view similar to that of FIG. 5, except that the structure is inflated.

The inflatable structure of the present invention may, of course, as shown in FIG. 5, consist merely of the inflatable cushion with walls 11 and 12, having elastomeric resilient panel 13 with slits or incisions 14 attached to the outer surface of wall 12.

Figure 1:
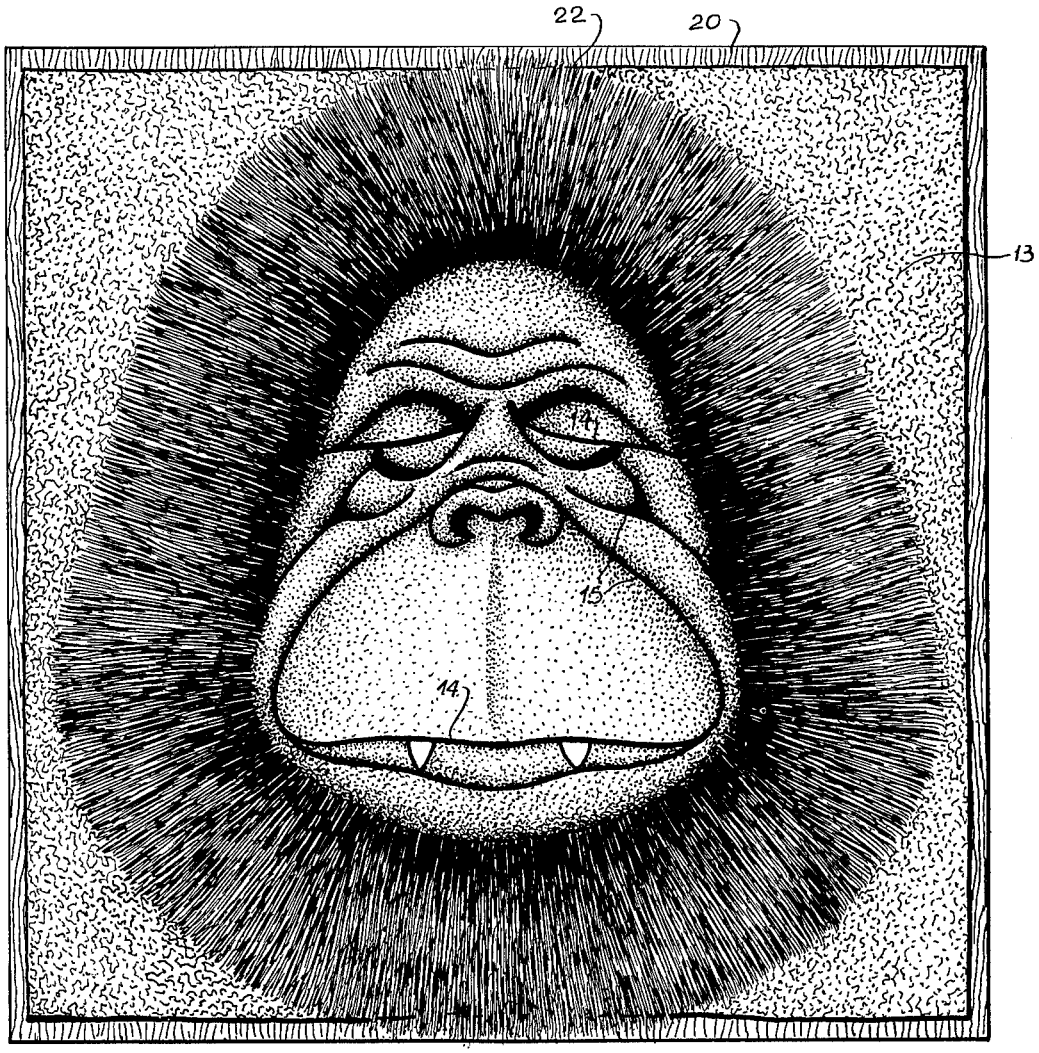
FIG. 1, is an upper plan view of one embodiment of the invention in which the inflatable structure is attached to a rigid support structure in the manner of a frame, in its deflated position.
Figure 2:
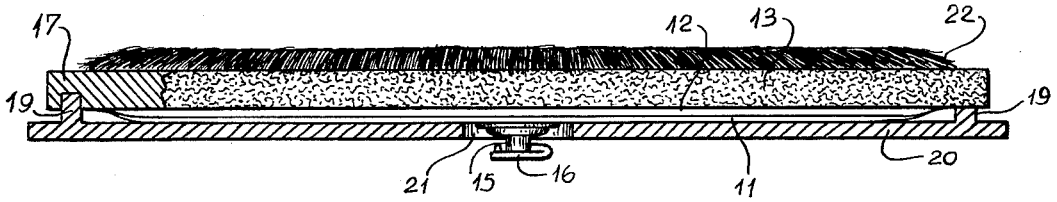
FIG. 2, is a view in lateral elevation of the same structure shown in FIG. 1.
Figure 3:
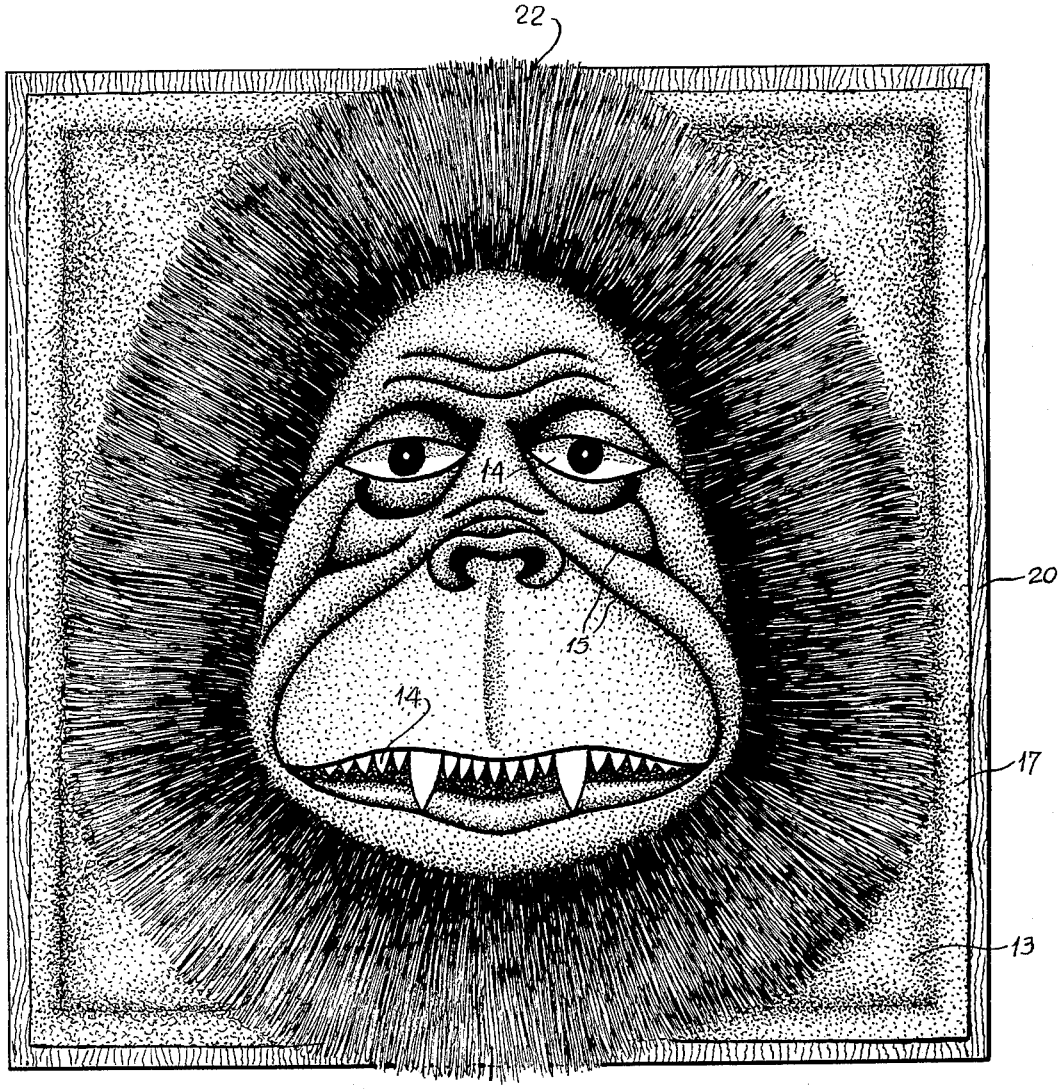
FIG. 3, is a view similar to that of FIG. 1, except that the structure is now inflated.

When this inflatable structure is attached to a rigid support 20, it has the appearance of a picture which can be hung to decorate a wall. Furthermore, the inflatable structure can be produced commercially without any allusive imprint made with slits, allowing the user to develop his creativity, painting and making cuts on the elastomeric resilient panel 13 for the subjects his personal taste dictates. In FIGS. 1 and 3, in addition to slits 14, there are included printed lines 15 with attachments of hair 22 to illustrate how any kind of ornamentation can be combined upon the resilient elastomeric panel 13 to achieve the desired presentation.

While the foregoing description is drawn to a specific embodiment of the invention, it will be clear to all persons skilled in the art that changes in form and detail, such as the disposition and placement of cuts, the use of a rigid support, etc., are within the scope and coverage of this invention.

I claim:

1. An inflatable structure comprising an inflatable cushion having valve means for admission of gas into said cushion, wherein at least one of the outer surfaces of said cushion has an elastomeric resilient panel of considerable thickness attached thereto;

said elastomeric resilient panel being projected peripherally some distance beyond the edge of the cushion forming a flange;

said flange of said resilient panel having on the same wall thereof attached to said cushion, slot means near the edge thereof;

said rigid support plate having rib means near the edges thereof;

said rib means engaging said slot means of said flange coupling fixedly said inflatable cushion to said rigid support;

said elastomeric resilient panel having a representation printed thereon;

slit means forming lines of said representations printed on said resilient panel;

said slit means having printed portions on their inner surfaces thereof;

said printed representations on said inner surfaces of said slit means being visible when said structure is inflated providing a low relief figure.

2. An inflatable structure in accordance with claim 1, wherein said rigid support includes a hole permitting said valve means passing therethrough.

3. An inflatable structure comprising an inflatable cushion having valve means for admission of gas into said cushion, wherein at least one of the outer surfaces of said cushion has an elastomeric resilient panel of considerable thickness attached thereto;

said resilient panel having representations printed thereon;

slit means forming lines of said representations printed on said elastomeric resilient panel;

said slit means having printed portions on their inner surfaces thereof; whereby when said structure is inflated to cause said resilient panel to stretch and expand said slit means said printed portions on said inner surfaces of said slit means become visible.

* * * * *